US012490850B1

(12) United States Patent
Savar

(10) Patent No.: US 12,490,850 B1
(45) Date of Patent: Dec. 9, 2025

(54) CAP HOLDER

(71) Applicant: Albert Avi Savar, New York, NY (US)

(72) Inventor: Albert Avi Savar, New York, NY (US)

( * ) Notice: Subject to any disclaimer, the term of this patent is extended or adjusted under 35 U.S.C. 154(b) by 0 days.

(21) Appl. No.: 18/735,524

(22) Filed: Jun. 6, 2024

(51) Int. Cl.

| | |
|---|---|
| ***A47G 25/10*** | (2006.01) |
| ***A42B 1/002*** | (2021.01) |
| *A47C 7/64* | (2006.01) |
| *A47F 7/06* | (2006.01) |

(52) U.S. Cl.
CPC ..... *A47G 25/10* (2013.01); *A42B 1/002* (2013.01); *A47C 7/64* (2013.01); *A47F 7/06* (2013.01)

(58) Field of Classification Search
CPC ..... A47G 25/10; A42B 1/002; A42B 3/125; A42B 3/127; A42B 3/064; A42B 3/12; A47F 7/06; A47F 7/065; A47C 7/64
See application file for complete search history.

(56) References Cited

U.S. PATENT DOCUMENTS

| | | | | | |
|---|---|---|---|---|---|
| 1,069,893 | A * | 8/1913 | Mendelson | A47G 25/10 | 211/32 |
| 1,763,899 | A * | 6/1930 | McClay | A61F 9/045 | 2/12 |
| 4,491,256 | A * | 1/1985 | Payne | D06F 59/02 | 223/24 |
| 4,708,271 | A * | 11/1987 | Grommes | A42C 3/00 | 211/32 |
| 4,858,247 | A * | 8/1989 | Hooser | D06F 59/00 | 2/181.4 |
| D366,732 | S * | 1/1996 | Gregg | D29/108 | |
| D370,309 | S * | 5/1996 | Stucky | D29/102 | |
| 5,790,988 | A * | 8/1998 | Guadagnino, Jr. | A42B 3/00 | 2/425 |
| 6,263,515 | B1 * | 7/2001 | Turner | A42B 3/00 | 2/410 |
| D564,134 | S * | 3/2008 | Brundage | D29/102 | |
| D565,799 | S * | 4/2008 | Timms | D29/102 | |
| 8,108,944 | B1 * | 2/2012 | Gilson, Sr. | A42B 1/24 | 2/209.3 |
| 8,287,045 | B1 * | 10/2012 | Donohue | B60N 2/2851 | 297/487 |
| D806,993 | S * | 1/2018 | Alonso | D2/882 | |
| 10,390,582 | B2 * | 8/2019 | Copeland | A42B 1/02 | |
| 11,363,848 | B1 * | 6/2022 | Goodman | A42B 1/248 | |
| 11,832,671 | B1 * | 12/2023 | Cardenas, III | B65D 85/18 | |
| 11,937,720 | B1 * | 3/2024 | Jiang | A47G 25/10 | |
| D1,033,805 | S * | 7/2024 | Weems | D2/894 | |
| 12,239,194 | B1 * | 3/2025 | Marshall | A45C 11/26 | |
| 2007/0039903 | A1 * | 2/2007 | Aiken | A47G 25/10 | 211/30 |

(Continued)

*Primary Examiner* — Devin K Barnett
(74) *Attorney, Agent, or Firm* — McCarter & English, LLP

(57) ABSTRACT

Exemplary embodiments are directed to cap holder for stacked caps. Each of the stacked caps includes a crown and a visor extending from the crown. The cap holder includes a front support panel configured to be positioned against a front surface of the crown of a topmost cap of the stacked caps. The cap holder includes a structure configured to be positioned under the crown of a bottommost cap of the stacked caps. The cap holder includes a first, second and third straps extending from edges of the front support panel and configured to at least partially wrap around the stacked caps to engage with the structure, thereby maintaining the caps in the stacked configuration.

20 Claims, 10 Drawing Sheets

(56) References Cited

U.S. PATENT DOCUMENTS

| | | | | |
|---|---|---|---|---|
| 2011/0214213 | A1* | 9/2011 | Foreman | A42B 1/0188 2/7 |
| 2013/0219593 | A1* | 8/2013 | Snyder | A42B 1/08 2/411 |
| 2014/0259286 | A1* | 9/2014 | Boyle | A41D 20/00 2/181 |
| 2015/0237944 | A1* | 8/2015 | Floyd, Jr. | A42B 1/08 2/414 |
| 2017/0238643 | A1* | 8/2017 | Pereira | A42B 3/14 |
| 2018/0368602 | A1* | 12/2018 | Albanese | F16B 45/023 |
| 2022/0039499 | A1* | 2/2022 | Brose | A42B 3/14 |
| 2023/0309639 | A1* | 10/2023 | Twining | A42B 1/002 2/175.4 |
| 2025/0057301 | A1* | 2/2025 | Wong | A45F 5/00 |

* cited by examiner

CAP HOLDER

TECHNICAL FIELD

The present disclosure relates to a cap holder and, in particular, to a cap holder capable of conveniently securing multiple caps together for transport and/or storage.

BACKGROUND

A typical household usually contains multiple hats or caps which may be worn casually or for specific occasions. Caps are typically stored on a shelf or around the house, resulting in potential loss or misplacement of a cap. In addition, such conventional storage can result in a disorganized look on the shelf. During travel, caps are generally placed loosely into a suitcase and can become separated from each other during the trip. Packing caps in a suitcase can also result in the caps being crumpled and damaged as there is nothing in the suitcase to help keep their shape.

Thus, a need exists for a cap holder that allows for stacking multiple caps together for storage and/or travel in an efficient, secure and convenient manner. These and other needs are addressed by the cap holder of the present disclosure.

SUMMARY

In accordance with embodiments of the present disclosure, an exemplary cap holder for stacked caps is provided. Each cap of the stacked caps includes a crown and a visor extending from the crown. The cap holder includes a front support panel configured to be positioned against a front surface of the crown of a topmost cap of the stacked caps. The front support panel includes a top edge, a bottom edge, a first side edge, and a second side edge. The cap holder includes a structure configured to be positioned under the crown of a bottommost cap of the stacked caps. The cap holder includes a first strap extending from the bottom edge of the front support panel and configured to at least partially wrap around the visor of the stacked caps to engage with the structure. The cap holder includes a second strap extending from the first side edge of the front support panel and configured to at least partially wrap around a first side of the topmost cap of the stacked caps to engage with the structure. The cap holder includes a third strap extending from the second side edge of the front support panel and configured to at least partially wrap around a second side of the topmost cap of the stacked caps to engage with the structure.

The first strap, the second strap and the third strap wrap around the stacked caps to maintain the stacked caps together. In some embodiments, the front support panel can be fabricated from a flexible material. Each of the first strap, the second strap, and the third strap can be flexible and adjustable in length. In some embodiments, the cap holder can include a fourth strap extending from the top edge of the front support panel, the fourth strap configured to at least partially wrap around the crown of the topmost cap of the stacked caps to engage with the structure.

In some embodiments, each of the first strap, the second strap, and the third strap can include a slider for adjustment of a length of the respective first strap, the second strap, and the third strap. In some embodiments, each of the first strap, the second strap, and the third strap can include a fastening slider configured to engage with a respective loop of the structure. In such embodiments, the fastening slider can include a hook-shaped extension configured to pass through the respective loop of the structure to releasably engage with the structure.

In some embodiments, the structure can be a pouch defining a hollow interior. The pouch can include a top section and a bottom section hingedly connected to each other at a connection section. The pouch can include an attachment mechanism (e.g., a zipper, or the like) for selectively securing the top section to the bottom section. In some embodiments, the structure can include a rear support panel configured to engage with the respective first, second and third straps. In some embodiments, the rear support panel can be fixedly secured to the structure. In some embodiments, the rear support panel can be releasably secured to the structure.

In accordance with embodiments of the present disclosure, an exemplary cap holder for stacked caps is provided. Each of the stacked caps includes a crown and a visor extending from the crown. The cap holder includes a front support panel configured to be positioned against a front surface of the crown of a topmost cap of the stacked caps. The front support panel includes a top edge, a bottom edge, a first side edge, and a second side edge. The cap holder includes a pouch configured to be positioned under the crown of a bottommost cap of the stacked caps. The cap holder includes a first strap extending from the bottom edge of the front support panel and configured to at least partially wrap around the visor of the stacked caps to releasably engage with the pouch. The cap holder includes a second strap extending from the first side edge of the front support panel and configured to at least partially wrap around a first side of the topmost cap of the stacked caps to releasably engage with the pouch. The cap holder includes a third strap extending from the second side edge of the front support panel and configured to at least partially wrap around a second side of the topmost cap of the stacked caps to releasably engage with the pouch. The cap holder includes a fourth strap extending from the top edge of the front support panel and configured to at least partially wrap around the crown of the topmost cap of the stacked caps to releasably engage with the pouch.

In accordance with embodiments of the present disclosure, an exemplary method of securing a stack of caps is provided. Each cap of the stack of caps includes a crown and a visor extending from the crown. The method includes positioning a front support panel of a cap holder against a front surface of the crown of a topmost cap of the stacked caps. The front support panel including a top edge, a bottom edge, a first side edge, and a second side edge. The method includes positioning a structure of the cap holder under the crown of a bottommost cap of the stacked caps. The method includes at least partially wrapping around the visor of the stacked caps a first strap extending from the bottom edge of the front support panel and engaging the first strap with the structure. The method includes at least partially wrapping around a first side of the topmost cap of the stacked caps a second strap extending from the first side edge of the front support panel and engaging the second strap with the structure. The method includes at least partially wrapping around a second side of the topmost cap of the stacked caps a third strap extending from the second side edge of the front support panel and engaging the third strap with the structure.

The method can include adjusting a length of each of the first strap, the second strap and the third strap. In some embodiments, the method can include at least partially wrapping around the crown of the topmost cap of the stacked caps a fourth strap extending from the top edge of the front support panel and engaging the fourth strap with the structure. In some embodiments, the structure can be a pouch including a top section and a bottom section hingedly connected to each other by a zipper, the pouch defining a hollow interior.

Other objects and features will become apparent from the following detailed description considered in conjunction with the accompanying drawings. It is to be understood, however, that the drawings are designed as an illustration only and not as a definition of the limits of the invention.

BRIEF DESCRIPTION OF THE DRAWINGS

To assist those of skill in the art in making and using the disclosed cap holder, reference is made to the accompanying figures, wherein.

DETAILED DESCRIPTION

Figure 1:
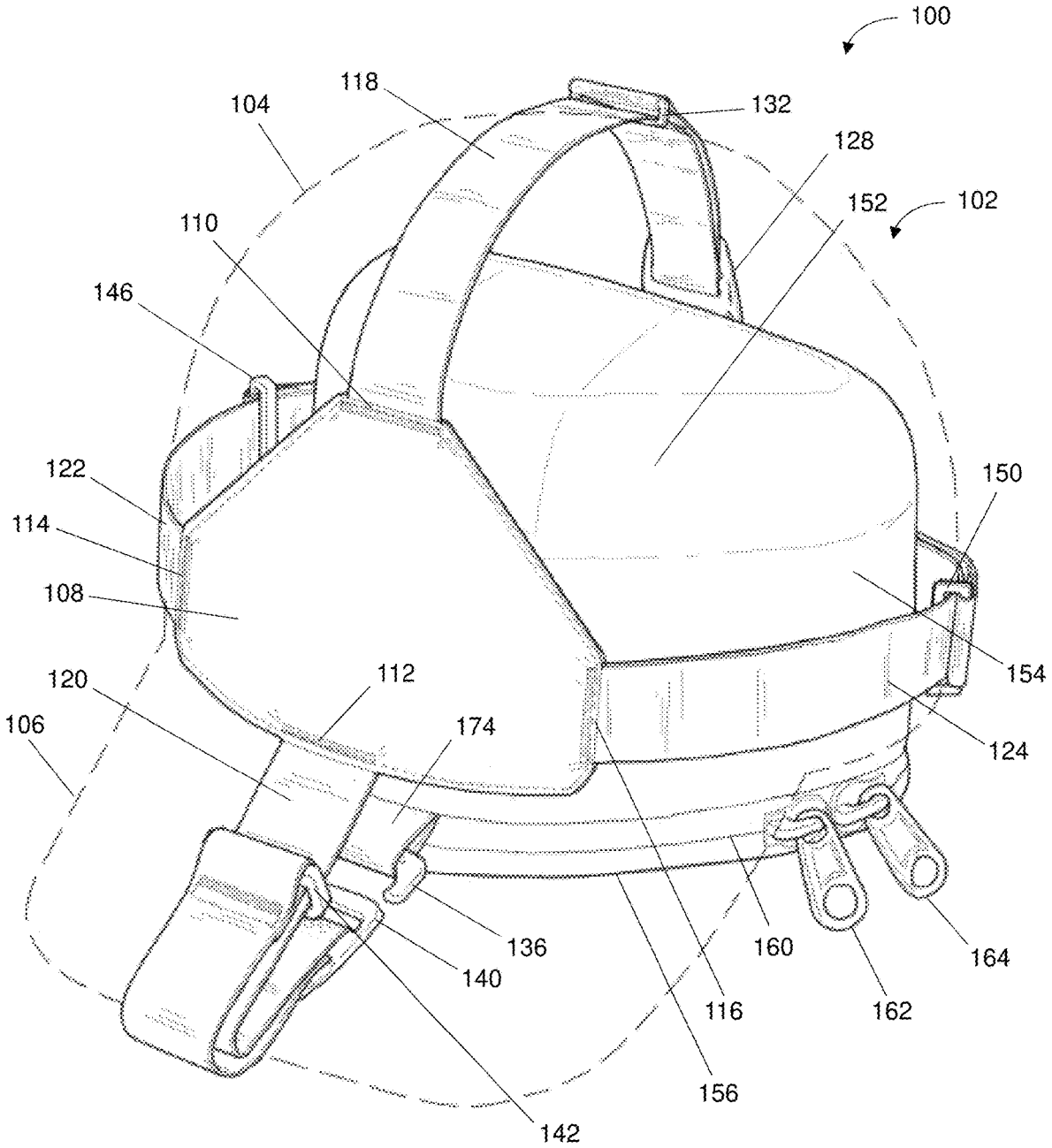
FIG. 1 is a front perspective view of an exemplary cap holder in accordance with embodiments of the present disclosure.
Figure 2:
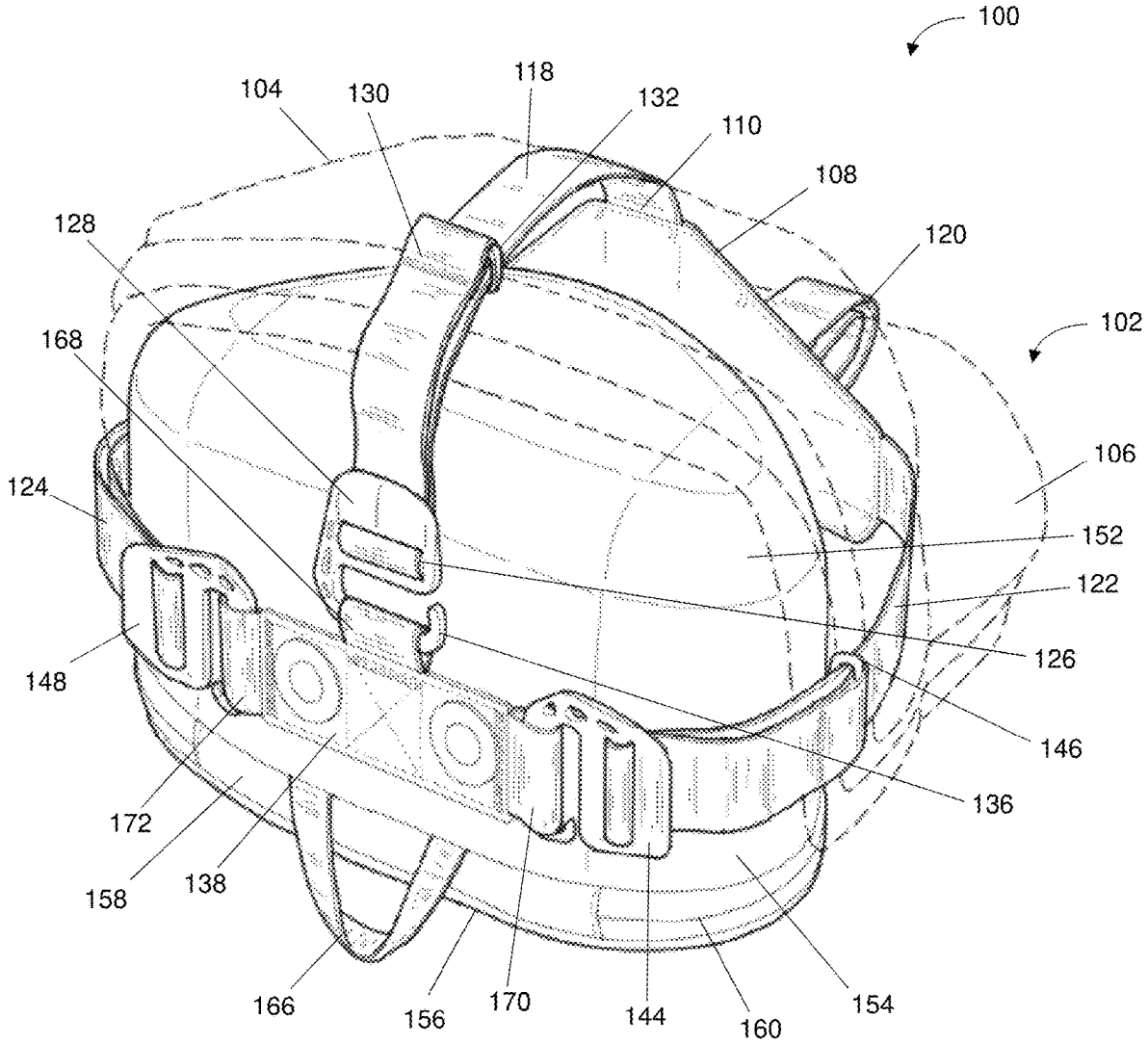
FIG. 2 is a rear perspective view of an exemplary cap holder of FIG. 1.
Figure 3:
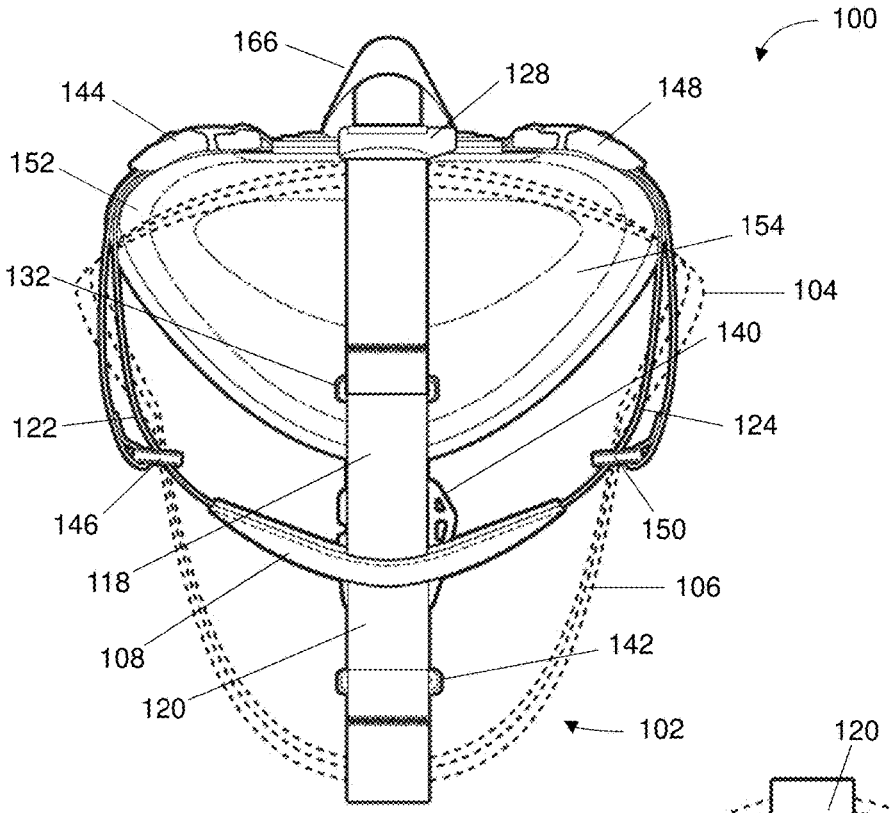
FIG. 3 is a top view of an exemplary cap holder of FIG. 1.
Figure 4:
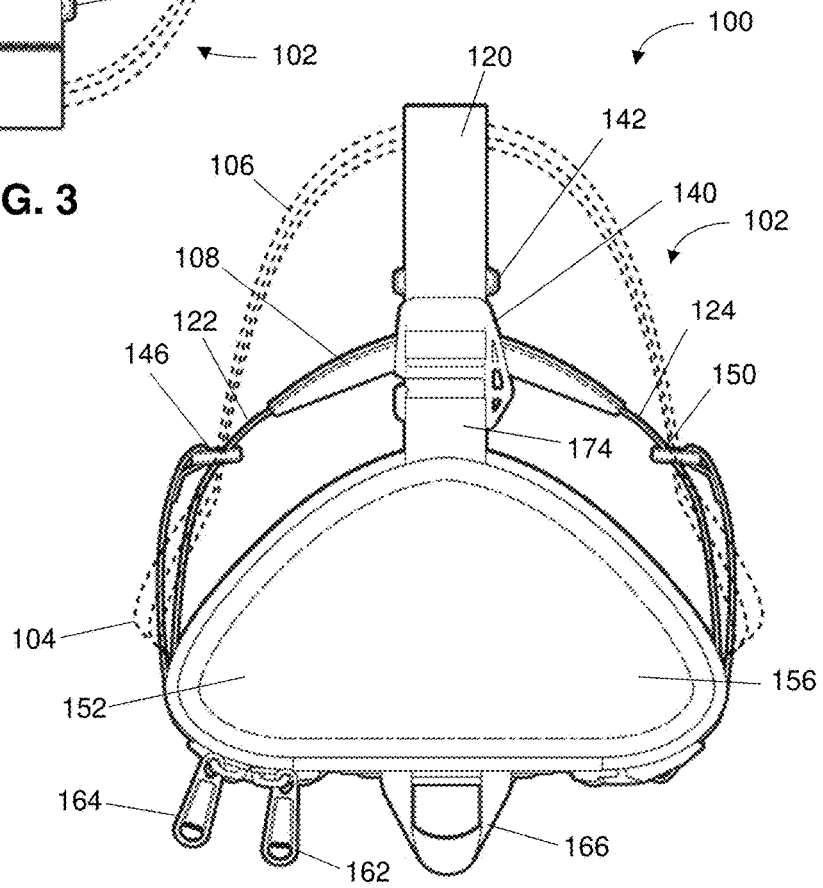
FIG. 4 is a bottom view of an exemplary cap holder of FIG. 1.
Figure 5:
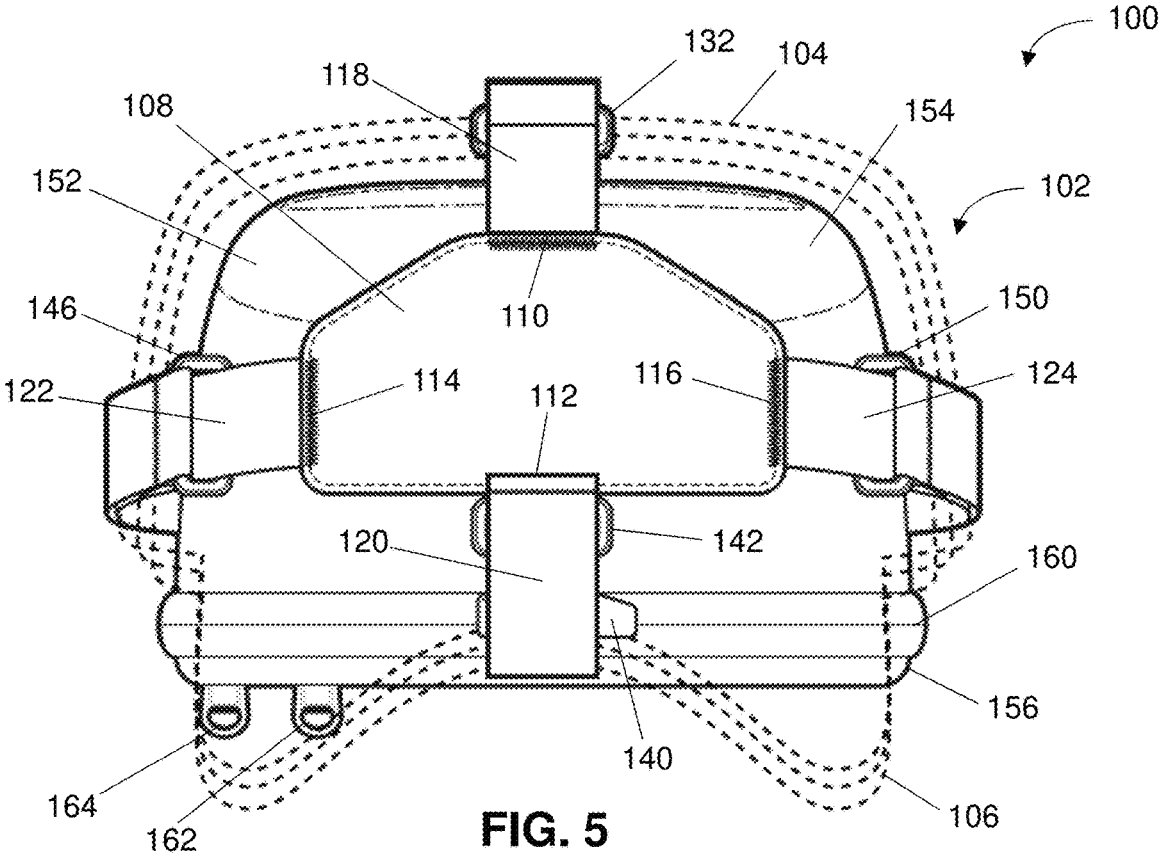
FIG. 5 is a front view of an exemplary cap holder of FIG. 1.
Figure 6:
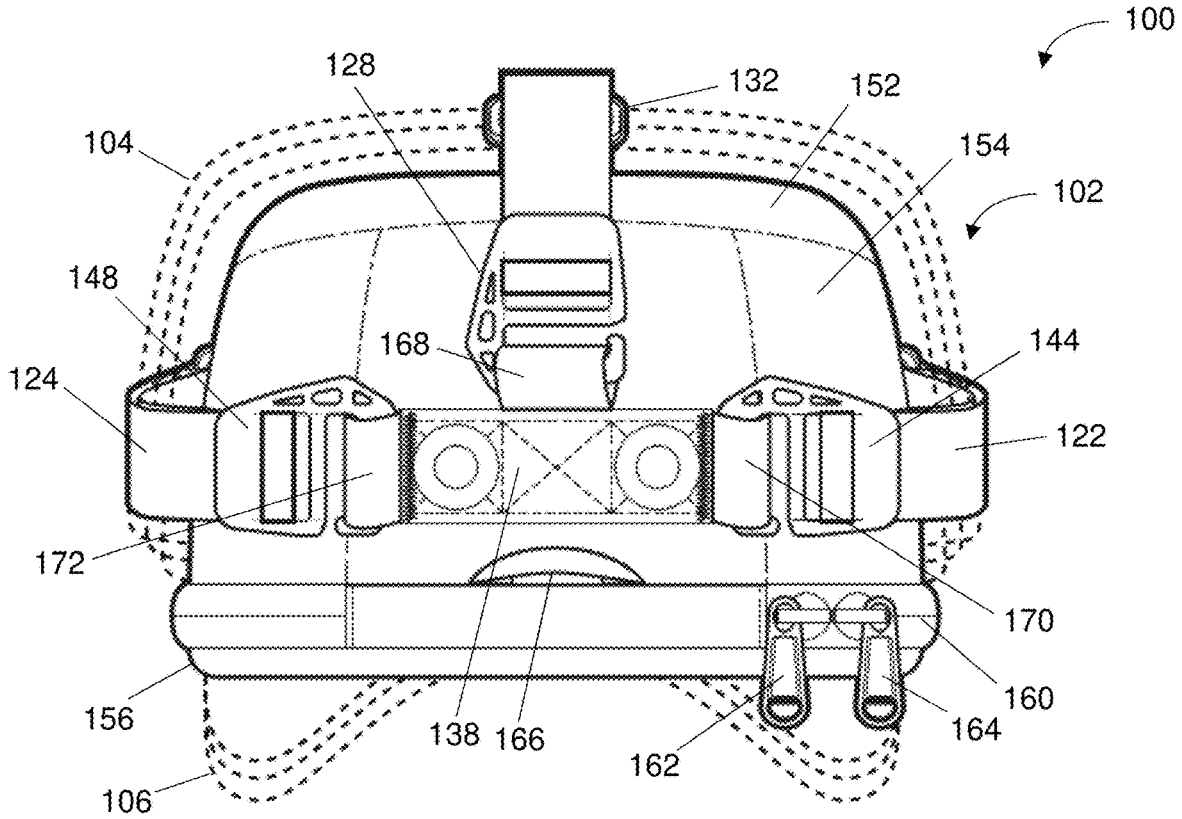
FIG. 6 is a rear view of an exemplary cap holder of FIG. 1.
Figure 7:
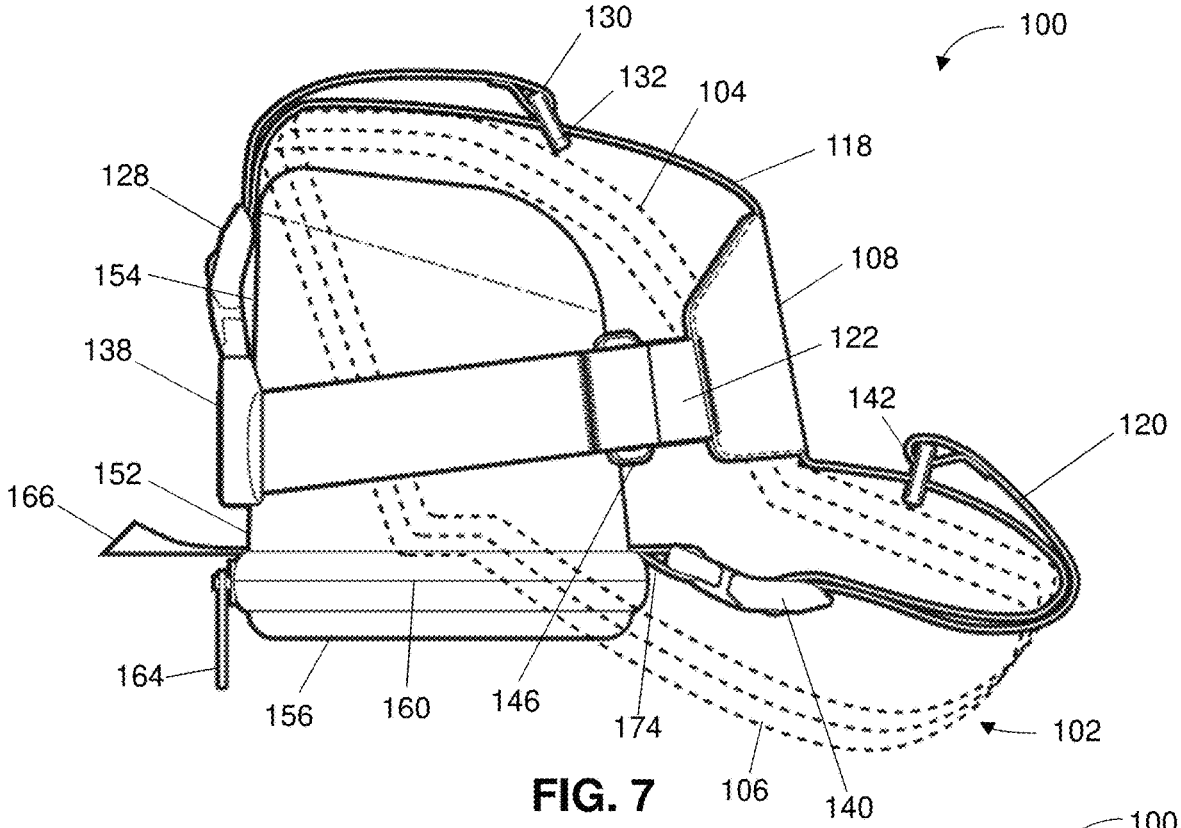
FIG. 7 is a right side view of an exemplary cap holder of FIG. 1.
Figure 8:
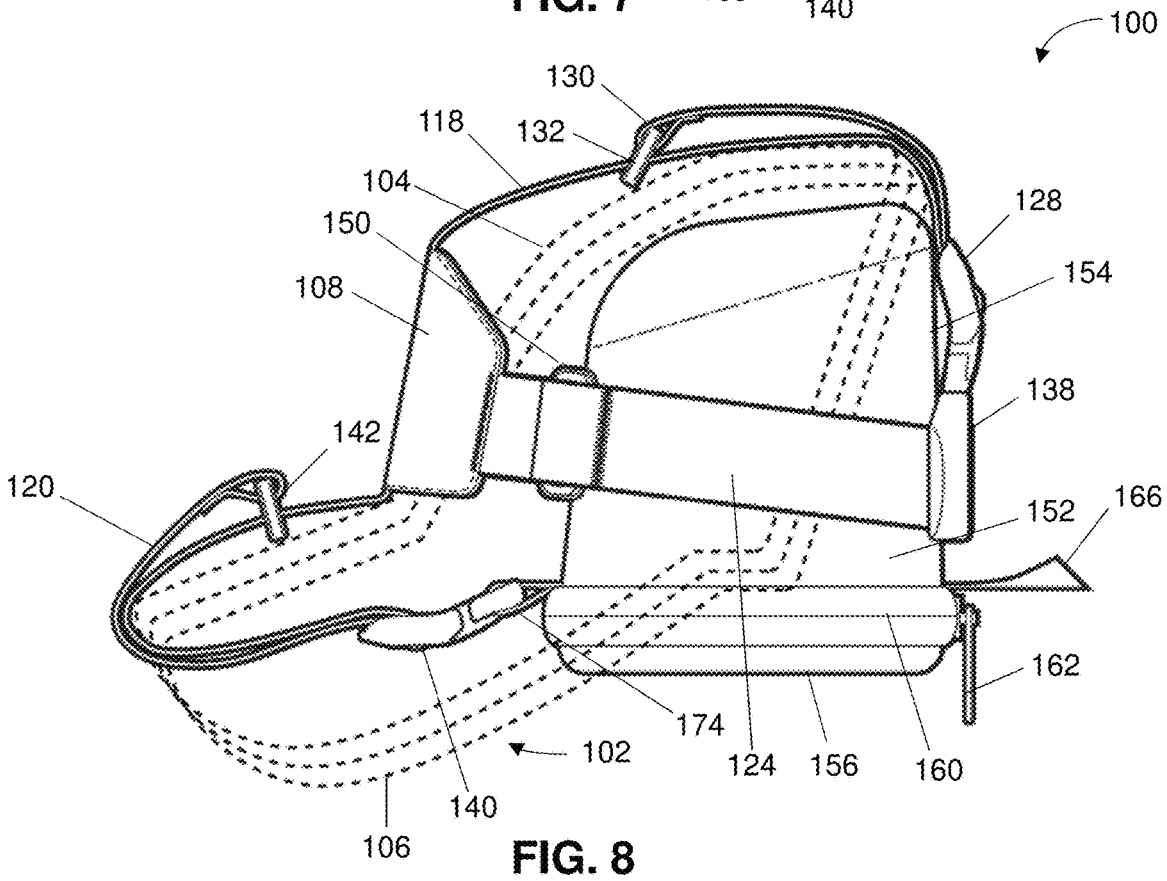
FIG. 8 is a left side view of an exemplary cap holder of FIG. 1.

FIGS. 1-8 are perspective, top, bottom, front, rear and side views of an exemplary cap holder 100 of the present disclosure. As discussed herein, the cap holder 100 allows for multiple caps 102 to be stacked on top of each other and secured together for transport and/or storage. Caps 102 typically include a crown 104 and a visor 106 extending from the front edge of the crown 104. For use with the holder 100, the crown 104 can be folded inward onto itself to create a concave inner surface. The crowns 104 of the adjacent caps 102 can thereby be stacked on top of each other with the visors 106 also stacked upon each other and extending in the same direction. (See, e.g., FIG. 2). The caps 102 can thereby be compactly stacked on top of each other before being secured in the stacked configuration with the holder 100.

The holder 100 includes a front support panel 108 configured to be positioned against the front surface of the crown 104 of the topmost cap 102. Although illustrated as having a generally triangular shape, it should be understood that the front support panel 108 can be of any configuration, e.g., square, rectangular, oval, circular, or the like. The front support panel 108 can be fabricated from a flexible or molded material, e.g., a woven material, a hard shell, leather, plastic, or the like. The front support panel 108 generally defines a thin profile with flat front and rear opposing surfaces. The flexible nature of the front support panel 108 is intended to allow the front support panel 108 to rest against and conform to the shape of the front surface of the crown 104 of the cap 102. In some embodiments, the front surface of the support panel 108 can include branding or marketing information printed or secured thereon.

The front support panel 108 includes a top edge 110, an opposing bottom edge 112 extending substantially parallel to the top edge 110, and opposing side edges 114, 116 extending substantially parallel to each other and perpendicular to the top and bottom edges 110, 112. The edges 110, 112, 114, 116 form connection points for straps 118, 120, 122, 124 of the holder 100. In particular, the ends of the straps 118, 120, 122, 124 can be secured (e.g., glued, sewn, or the like) to the respective edges 110, 112, 114, 116. Each of the straps 118, 120, 122, 124 is fabricated from a flexible material (e.g., a woven material, or the like) such that the straps 118, 120, 122, 124 can wrap around and conform to the respective sides of the cap 102 for secure engagement of the holder 100 around the cap 102. In some embodiments, rather than a front support panel 108 connecting the straps 118, 120, 122, 124, the straps 118, 120, 122, 124 can be jointed together by a smaller, central connection point through which the straps 118, 120, 122, 124 extend.

The strap 118 extends from the top edge 110 and is configured to wrap at least partially over the top of the crown 104 of the topmost cap 102. The strap 120 extends from the bottom edge 112 and is configured to wrap at least partially under the bottom of the visor 106 of the bottommost cap 102. The curvature of the visor 106 can assist in maintaining the position of the strap 120. (See, e.g., FIG. 5). The strap 122 extends from the left side edge 114 and is configured to wrap at least partially around the left side of the crown 104 of the topmost cap 102. The strap 124 extends from the right side edge 116 and is configured to wrap at least partially around the right side of the crown 104 of the topmost cap 102.

The strap 118 passes through slots 126 of a hook or fastening slider 128 such that the direction of extension of the strap 118 is reversed. The strap 118 therefore passes through the slots 126 and wraps around a section of the slider 128 to engage with the slider 128. The end 130 of the strap 118 forms a loop which is secured to another slider 132. The strap 118 therefore passes through the fastening slider 128 and subsequently passes over itself (e.g., forming upper and lower levels) before engagement with the slider 132. The slider 132 is movably positioned around or engaged with the lower level of the strap 118 to allow for adjustment of the overall length of the strap 118 (thereby simultaneously adjusting the position of the fastening slider 128). Once the desired length of the strap 118 has been achieved using the slider 132, the fastening slider 128 can be moved to the "endpoint" of the adjusted strap 118. The strap 118 length can therefore be customized based on the number of caps 102 being secured by the holder 100. The fastening slider 128 includes a hook-shaped extension 136 protruding therefore in-line with the section of the slider 128 with the slots 126. As discussed below, the extension 136 allows the strap 118 to be selectively engaged and disengaged relative to a rear support panel 138 of the holder 100.

Each of the straps 120, 122, 124 can have a substantially similar structure and function to the strap 118. In particular, the strap 120 passes through a fastening slider 140 to reverse its direction over itself, and the end of the strap 120 includes a loop secured to a slider 142. The strap 122 passes through a fastening slider 144 to reverse its direction over itself, and the end of the strap 122 includes a loop secured to a slider 146. The strap 124 passes through a fastening slider 148 to reverse its direction over itself, and the end of the strap 124 includes a loop secured to a slider 150. The length of each strap 118, 120, 122, 124 is therefore selectively adjustable depending on the number and/or size of the caps 102 being secured by the holder 100.

The holder 100 includes a pouch 152 configured to be positioned under the folded and stacked crown 104, e.g., under the bottommost cap 102. In some embodiments, rather than a pouch 152, the holder 100 can include a structure having a substantially similar configuration as the pouch 152, but without the hollow interior and features discussed herein. In some embodiments, the pouch 152 can define a substantially triangular or oval cross-section with a height substantially equal to or slightly greater than the height of the crown 104 relative to the bottom edge of the cap 102. Thus, when the pouch 152 is positioned under the crown 104 of the bottommost cap 102, the bottom of the pouch 152 protrudes out downwardly from the bottom of the stack of caps 102. (See, e.g., FIGS. 5 and 6).

The pouch 152 can include a substantially hollow interior configured to receive items of the user, thereby serving as a storage area, e.g., for sunglasses or other small items. In some embodiments, the hollow interior of the pouch 152 can include one or more dividers and/or zippered pockets to separate the pouch 152 into compartments. The pouch 152 can include a top section 154 and a bottom section 156 hingedly connected at a connection 158 at the rear of the pouch 152. The pouch 152 can include a zipper 160 that allows for the bottom section 156 to be selectively engaged and disengaged from the top section 154, thereby providing access to the interior of the pouch 152. One or more pull tabs 162, 164 can be used to open and close the zipper 160. In some embodiments, a hook and loop engagement (e.g., VELCRO®, or the like) can be used instead of the zipper 160.

The pouch 152 can include a loop 166 extending from the rear of the pouch 152. In some embodiments, the loop 166 can be used to hang the holder 100 for storage or to clip the holder 100 onto another item during travel. The rear support panel 138 can be secured to the rear surface of the pouch 152. In some embodiments, the rear support panel 138 can be fixedly secured to the pouch 152. In some embodiments, the rear support panel 138 can be detachably secured to the pouch 152 with, e.g., VELCRO®, snap buttons (as represented by two circles on the rear support panel 138), or the like.

The rear support panel 138 includes a loop 168 extending from the top edge, and similar loops 170, 172 extending from the side edges. In some embodiments, the loops 168, 170, 172 can extend directly from the pouch 152 (e.g., and the rear support panel 138 can be omitted). The pouch 152 includes a loop 174 extending from a front bottom edge of the pouch 152. The loops 168, 170, 172, 174 can be fabricated from a flexible material, e.g., a woven or stretchable fabric. The loop 168 is configured to receive therethrough the hook-shaped extension 136 of the slider 128 associated with the strap 118 to secure the strap 118 around the top of the cap 102. The loop 170 is configured to receive therethrough the hook-shaped extension 136 of the slider 144 associated with the strap 122 to secure the strap 122 around one side of the cap 102. The loop 172 is configured to receive therethrough the hook-shaped extension 136 of the slider 148 associated with the strap 124 to secure the strap 124 around another side of the cap 102. The loop 174 is configured to receive therethrough the hook-shaped extension 136 of the slider 140 associated with the strap 120 to secure the strap 120 around the visor 106 of the cap 102. Each of the sliders 128, 140, 144, 148 is releasable relative to the respective loops 168, 170, 172, 174.

Thus, in use, the caps 102 can first be stacked on top of each other. Next, the pouch 152 can be positioned under the crown 104 of the bottommost cap 102. The length of the straps 118, 120, 122, 124 can be adjusted (if needed) based on the size of the stack of caps 102. Finally, each of the straps 118, 120, 122, 124 can be looped around the stack of caps 102 and secured at their respective ends to the loops 168, 170, 172, 174. If needed, the length of the straps 118, 120, 122, 124 can be adjusted (e.g., tightened) to ensure the stack of caps 102 is secured held together by the holder 100. In this secured configuration, the stack of caps 102 remains grouped together, providing a convenient means for carrying multiple caps 102 together, or for packing multiple caps 102 together in a suitcase. If a cap 102 is to be removed, one or more of the straps 118, 120, 122, 124 can be disengaged from the respective loop 168, 170, 172, 174 to release the caps 102 for removal from the holder 100.

Figure 9:
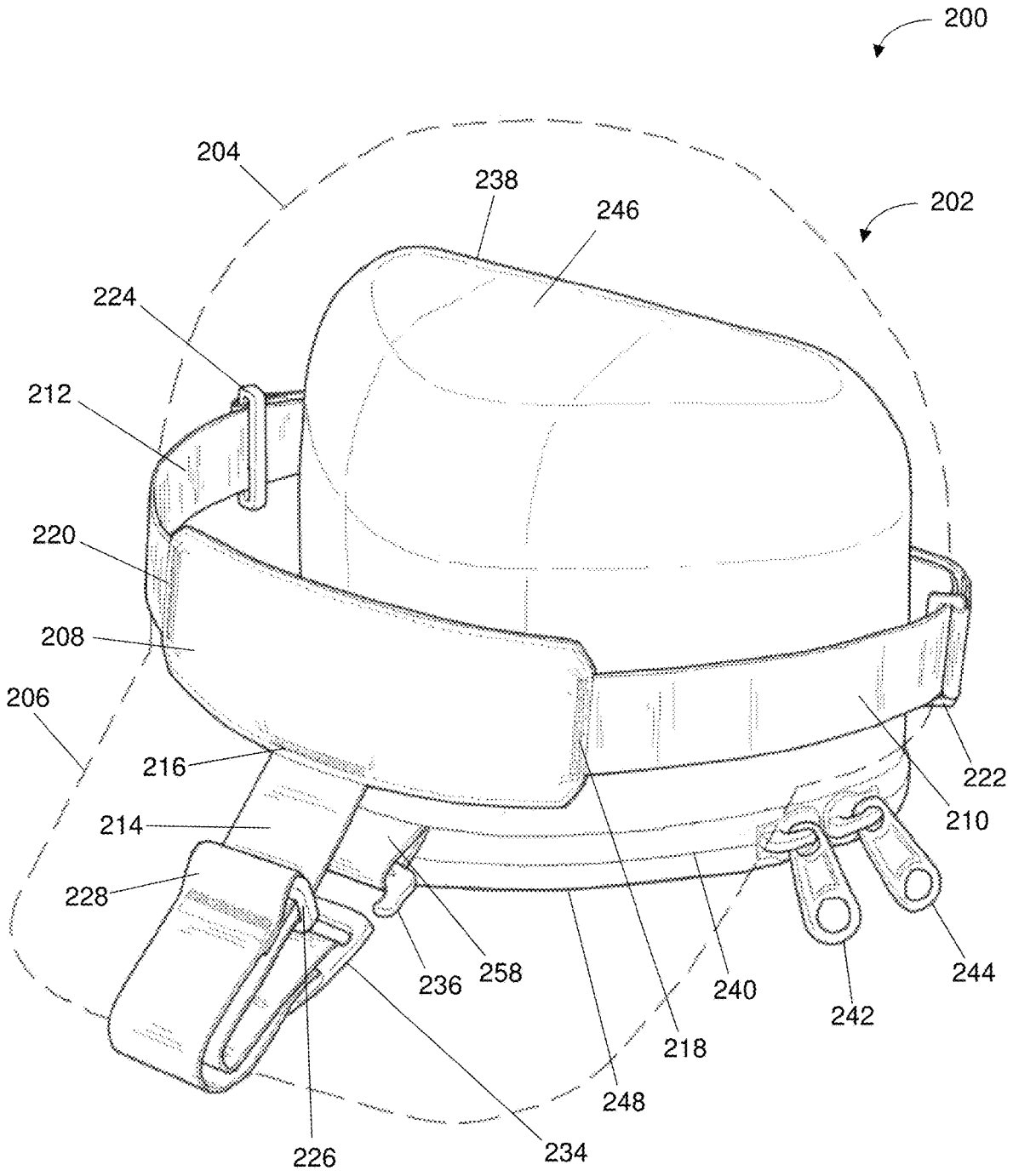
FIG. 9 is a front perspective view of an exemplary cap holder in accordance with embodiments of the present disclosure.
Figure 10:
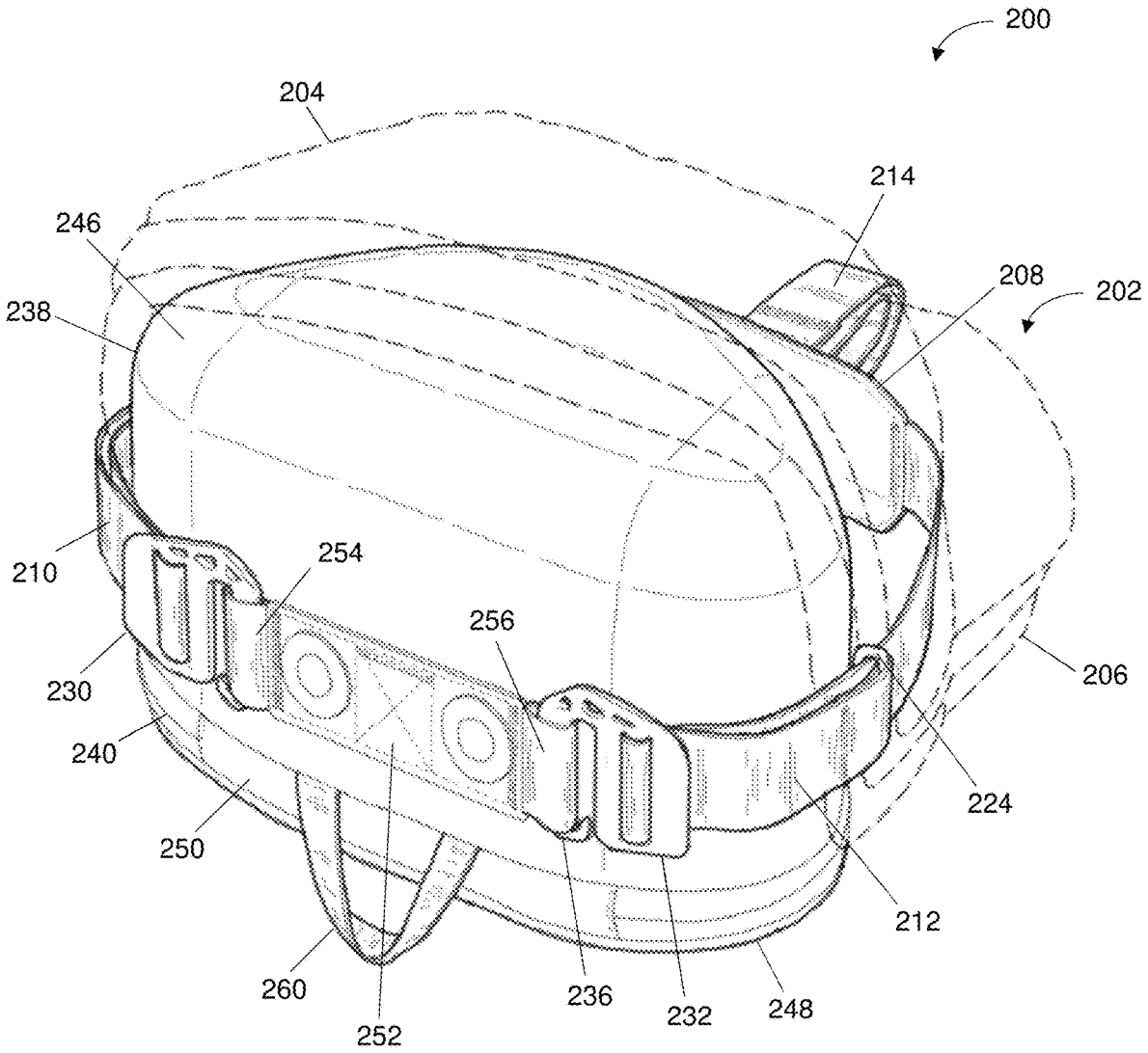
FIG. 10 is a rear perspective view of an exemplary cap holder of FIG. 9.
Figure 11:
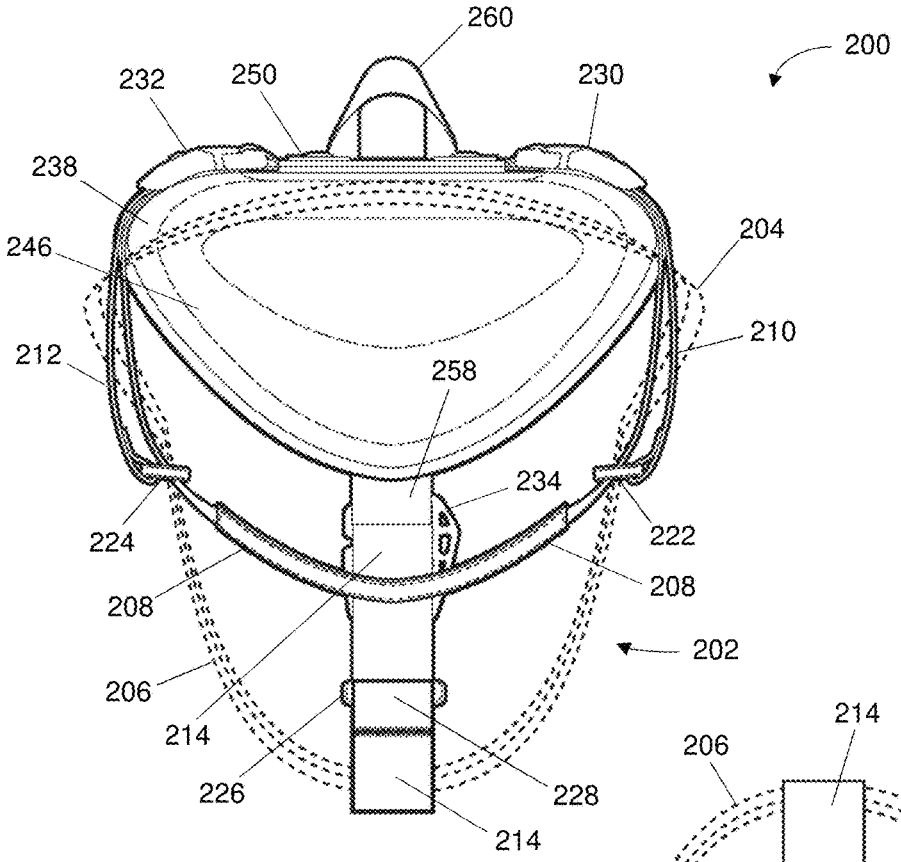
FIG. 11 is a top view of an exemplary cap holder of FIG. 9.
Figure 12:
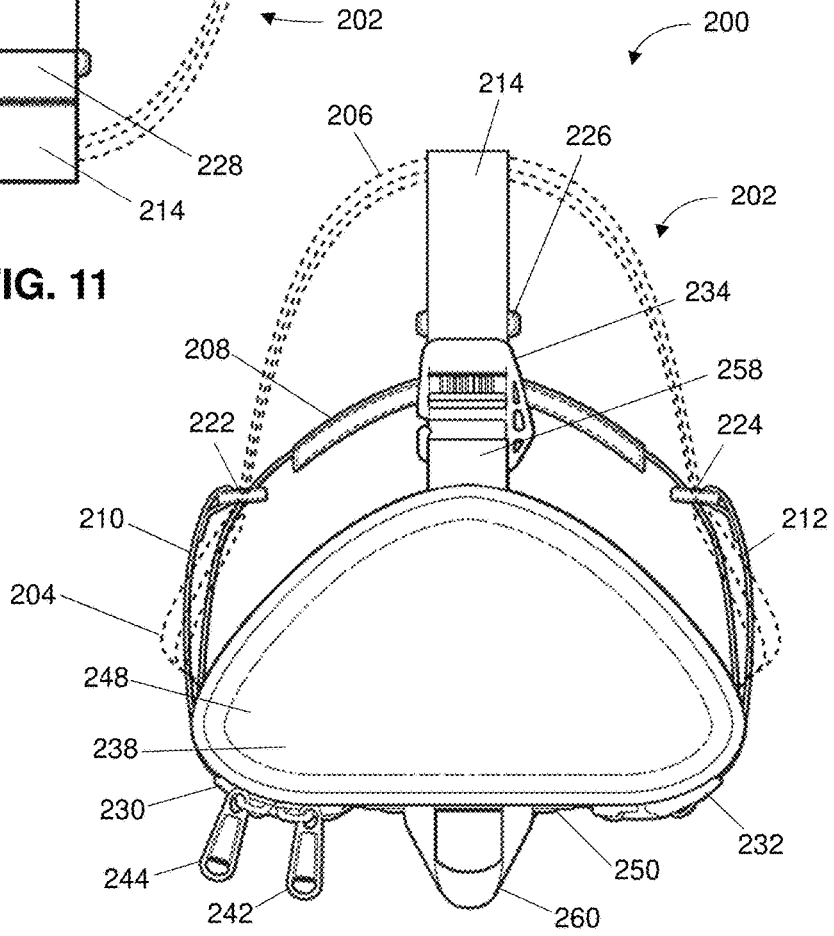
FIG. 12 is a bottom view of an exemplary cap holder of FIG. 9.
Figure 13:
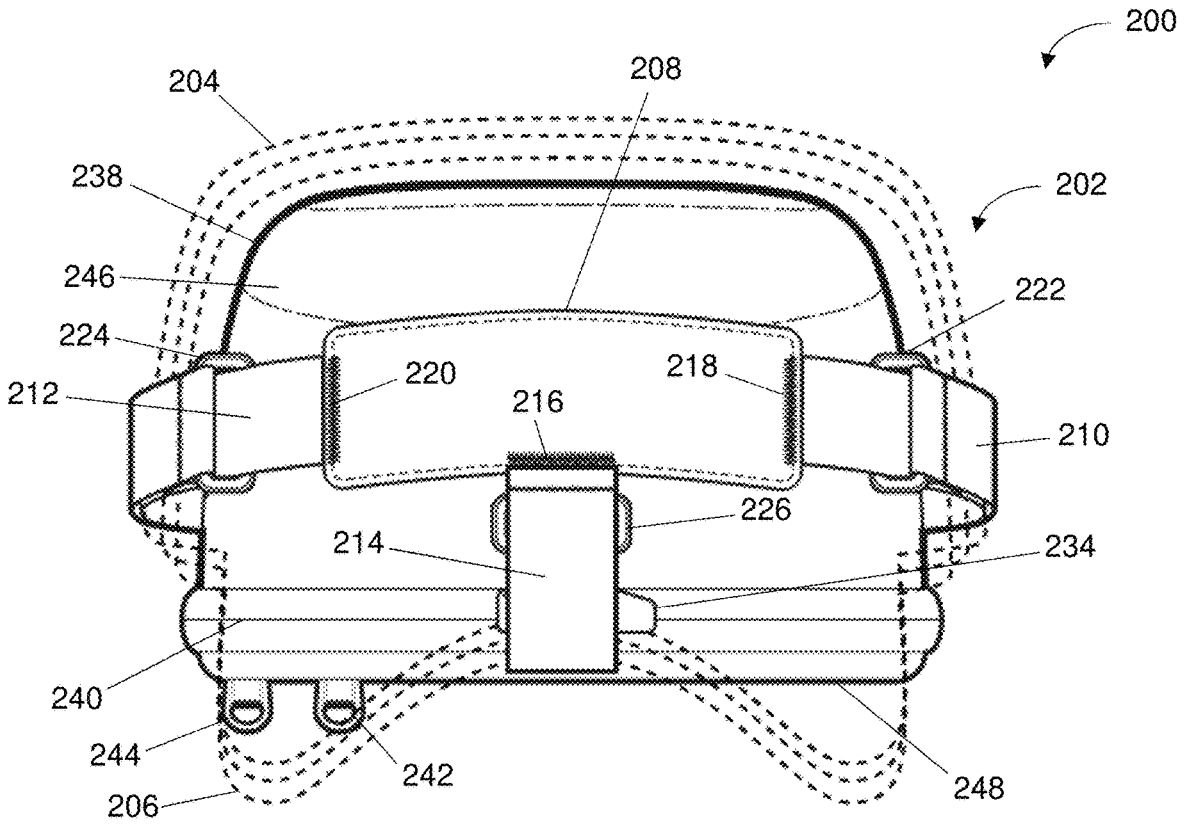
FIG. 13 is a front view of an exemplary cap holder of FIG. 9.
Figure 14:
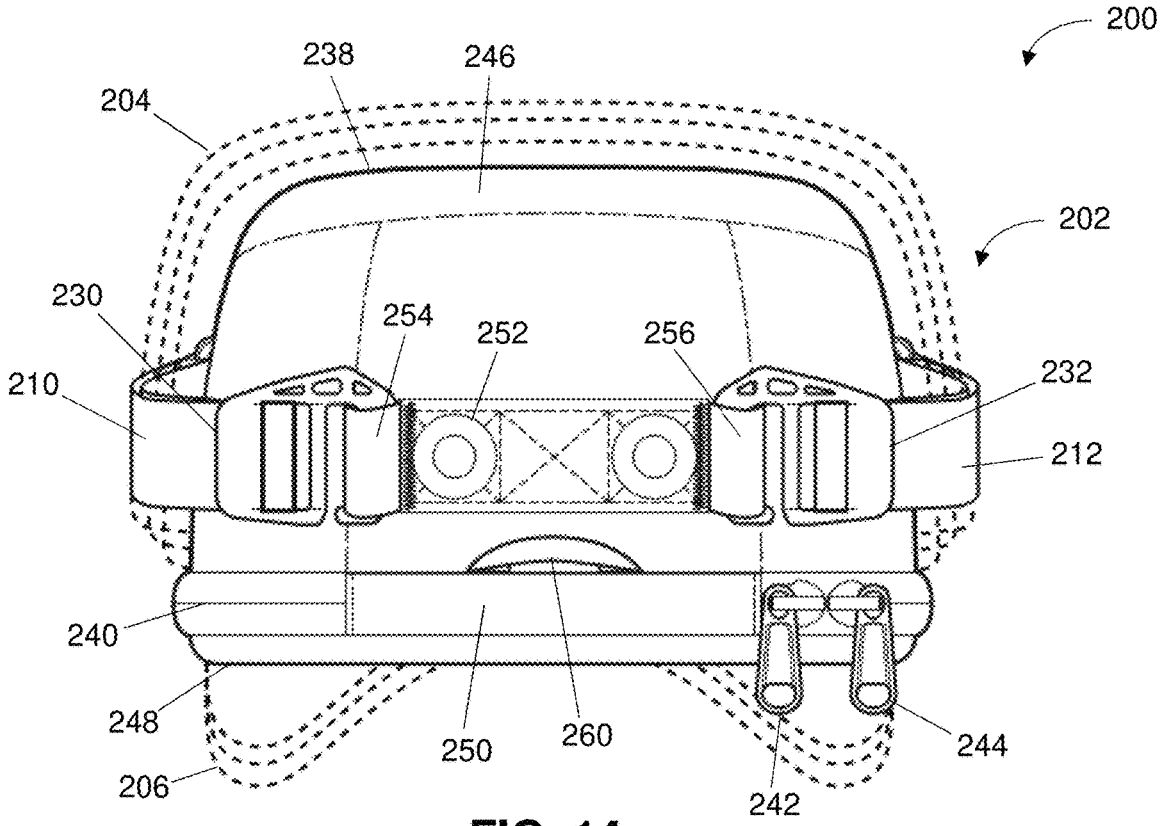
FIG. 14 is a rear view of an exemplary cap holder of FIG. 9.
Figure 15:
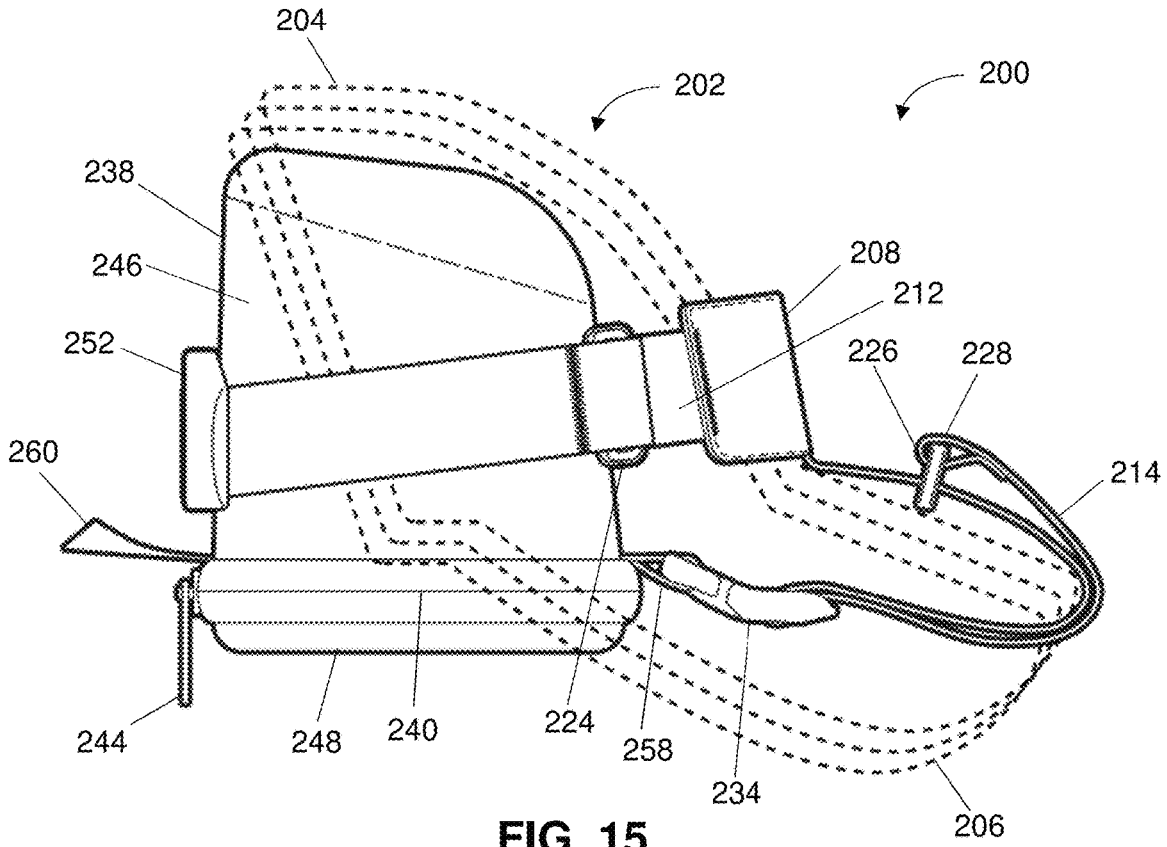
FIG. 15 is a right side view of an exemplary cap holder of FIG. 9.
Figure 16:
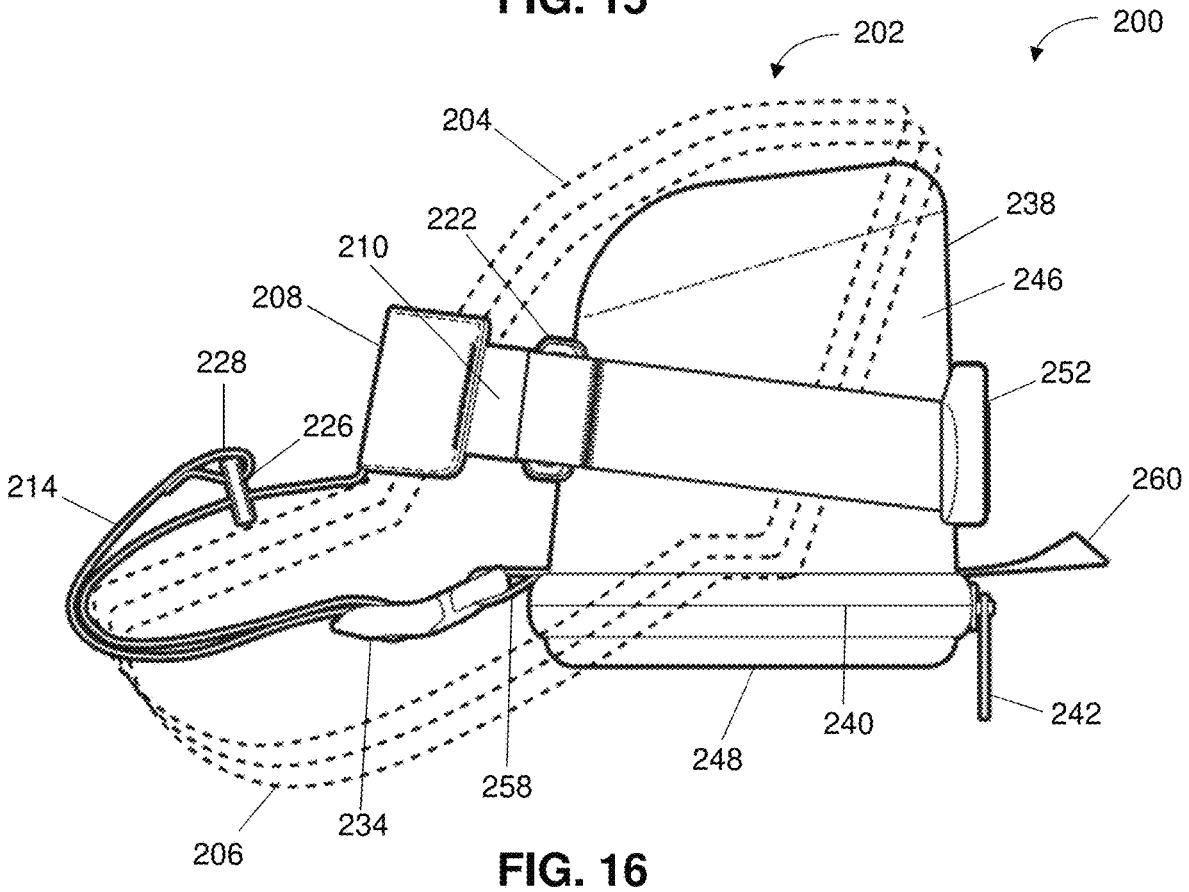
FIG. 16 is a left side view of an exemplary cap holder of FIG. 9.

FIGS. 9-16 are perspective, top, bottom, front, rear and side views of an exemplary cap holder 200 of the present disclosure. The cap holder 200 can be substantially similar in structure and function to the cap holder 100, except for the distinctions noted herein. Therefore, like reference numbers refer to like structures. Similar to the cap holder 100, the cap holder 200 allows for multiple caps 202 to be stacked on top of each other and secured together for transport and/or storage. The caps 202 include a crown 204 and a visor 206 extending from the front edge of the crown 204. The caps 202 are stacked upon each other before being secured in the stacked configuration with the holder 200.

The holder 200 includes a front support panel 208 defining a substantially rectangular configuration and configured to be positioned against the front surface of the crown 204. Rather than including four straps extending from the front support panel 208, the holder 200 includes three flexible straps 210, 212, 214 extending from the bottom edge 216 and the opposing side edges 218, 220 of the front support panel 208. As such, there is no strap extending over the top of the crown 206, and the straps 216, 218, 220 engage around sides and bottom of the stack of caps 202. The length of each strap 216, 218, 220 is independently adjustable using sliders 222, 224, 226 at the ends of the respective straps 216, 218, 220. The sliders 222, 224, 226 attach to loops 228 formed at the end of each strap 216, 218, 220. Each strap 216, 218, 220 further includes an intermediate fastening slider 230, 232, 234 having a hook-shaped extension 236 for engaged with loops of the holder 200.

The holder 200 includes a pouch 238 including a hollow interior accessible via a zipper 240 actuated to open and close via pull tabs 242, 244. The pouch 238 includes a top section 246 pivotally disposed relative to a bottom section 248 at a connection section 250. A user can thereby selectively open and close the pouch 238 to access its contents. The pouch 238 defines a substantially triangular or oval cross-section with a height dimensioned to fit within and extend out of the bottom of the folded crown 204 of the bottommost cap 202.

The pouch 238 can include a rear support panel 252 fixedly or detachably secured to the rear surface of the pouch 238. The side edges of the rear support panel 252 includes loops 254, 256 for releasably engagement with the hook-shaped extensions 236 of the fastening sliders 230, 232. The front bottom edge of the pouch 238 includes a loop 258 for releasable engagement with the hook-shaped extension 236 of the fastening slider 234. The pouch 238 can optionally include a loop 260 extending from a rear bottom edge for hanging the holder 200 or clipping the holder 200 to another item.

Use of the holder 200 can be substantially similar to the holder 100. The pouch 238 can be inserted under the stack of caps 202 and within the space defined by the crown 204 of the bottommost cap 202. The front support panel 208 is positioned against the front surface of the crown 204 of the topmost cap 202. Finally, the fastening sliders 230, 232, 234 of the straps 210, 212, 214 are engaged with the respective loops 254, 256, 258, and their length is adjusted (tightened or loosened) to ensure the caps 202 are adequately secured to each other with the holder 200. If any cap 202 in the stack is needed, one or more of the straps 210, 212, 214 can be disengaged to allow for removal of the cap 202 from the holder 200. Thus, both cap holders 100, 200 discussed herein provide a convenient and compact way of securing and storing multiple caps relative to each other.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A cap holder for stacked caps each cap including a crown and a visor extending from the crown, the cap holder comprising:

a front support panel configured to be positioned against a front surface of the crown of a topmost cap of the stacked caps, the front support panel including a top edge, a bottom edge, a first side edge, and a second side edge;

a structure configured to be positioned under the crown of a bottommost cap of the stacked caps;

a first strap extending directly from the bottom edge of the front support panel and configured to at least partially wrap around the visors of the stacked caps to engage with the structure;

a second strap extending directly from the first side edge of the front support panel and configured to at least partially wrap around a first side of the topmost cap of the stacked caps to engage with the structure; and a third strap extending directly from the second side edge of the front support panel and configured to at least partially wrap around a second side of the topmost cap of the stacked caps to engage with the structure.

2. The cap holder of claim 1, wherein the first strap, the second strap and the third strap are configured to wrap around the stacked caps to maintain the stacked caps together.

3. The cap holder of claim 1, wherein the front support panel is fabricated from a flexible material.

4. The cap holder of claim 1, wherein each of the first strap, the second strap, and the third strap is flexible and adjustable in length.

5. The cap holder of claim 1, further comprising a fourth strap extending from the top edge of the front support panel and configured to at least partially wrap around the crown of the topmost cap of the stacked caps to engage with the structure.

6. The cap holder of claim 1, wherein each of the first strap, the second strap, and the third strap include a slider for adjustment of a length of the respective first strap, the second strap, and the third strap.

7. The cap holder of claim 1, wherein each of the first strap, the second strap, and the third strap include a fastening slider configured to engage with a respective loop of the structure.

8. The cap holder of claim 7, wherein each fastening slider includes a hook-shaped extension configured to pass through the respective loop of the structure to releasably engage with the structure.

9. The cap holder of claim 1, wherein the structure is a pouch defining a hollow interior.

10. The cap holder of claim 9, wherein the pouch includes a top section and a bottom section hingedly connected to each other at a connection section.

11. The cap holder of claim 10, wherein the pouch includes an attachment mechanism for selectively securing the top section to the bottom section.

12. The cap holder of claim 11, wherein the attachment mechanism is a zipper.

13. The cap holder of claim 1, wherein the structure includes a rear support panel configured to engage with the respective first, second and third straps.

14. The cap holder of claim 13, wherein the rear support panel is fixedly secured to the structure.

15. The cap holder of claim 13, wherein the rear support panel is releasably secured to the structure.

16. A cap holder for stacked caps each cap including a crown and a visor extending from the crown, the cap holder comprising:

a front support panel configured to be positioned against a front surface of the crown of a topmost cap of the stacked caps, the front support panel including a top edge, a bottom edge, a first side edge, and a second side edge;

a pouch configured to be positioned under the crown of a bottommost cap of the stacked caps;

a first strap extending directly from the bottom edge of the front support panel and configured to at least partially wrap around the visors of the stacked caps to releasably engage with the pouch;

a second strap extending directly from the first side edge of the front support panel and configured to at least partially wrap around a first side of the topmost cap of the stacked caps to releasably engage with the pouch;

a third strap extending directly from the second side edge of the front support panel and configured to at least partially wrap around a second side of the topmost cap of the stacked caps to releasably engage with the pouch; and a fourth strap extending from the top edge of the front support panel and configured to at least partially wrap around the crown of the topmost cap of the stacked caps to releasably engage with the pouch.

17. A method of securing a stack of caps, each cap of the stack of caps including a crown and a visor extending from the crown, the method comprising:

positioning a front support panel of a cap holder against a front surface of the crown of a topmost cap of the stacked caps, the front support panel including a top edge, a bottom edge, a first side edge, and a second side edge;

positioning a structure of the cap holder under the crown of a bottommost cap of the stacked caps;

at least partially wrapping around the visors of the stacked caps a first strap extending from the bottom edge of the front support panel and engaging the first strap with the structure;

at least partially wrapping around a first side of the topmost cap of the stacked caps a second strap extending from the first side edge of the front support panel and engaging the second strap with the structure; and at least partially wrapping around a second side of the topmost cap of the stacked caps a third strap extending from the second side edge of the front support panel and engaging the third strap with the structure.

18. The method of claim 17, comprising adjusting a length of each of the first strap, the second strap and the third strap.

19. The method of claim 17, comprising at least partially wrapping around the crown of the topmost cap of the stacked caps a fourth strap extending from the top edge of the front support panel and engaging the fourth strap with the structure.

20. The method of claim 17, wherein the structure is a pouch including a top section and a bottom section hingedly connected to each other by a zipper, the pouch defining a hollow interior.

* * * * *